United States Patent [19]

Shibata et al.

[11] Patent Number: 4,633,276

[45] Date of Patent: Dec. 30, 1986

[54] THERMOSENSITIVE RECORDING LABEL

[75] Inventors: Tomoo Shibata, Irvine; Wissam J. Jurdi, Corona, both of Calif.

[73] Assignee: Ricoh Electronics, Inc., Santa Ana, Calif.

[21] Appl. No.: 770,600

[22] Filed: Aug. 29, 1985

Related U.S. Application Data

[63] Continuation-in-part of Ser. No. 614,287, May 25, 1984, Pat. No. 4,577,204.

[51] Int. Cl.[4] ..... B41M 5/18

[52] U.S. Cl. ..... 346/200; 346/226; 427/150; 427/152; 428/40; 428/352; 428/354; 428/355; 428/913; 428/914

[58] Field of Search ..... 346/200, 201, 204, 226; 427/150, 151, 152; 428/40, 201-204, 206, 207, 352, 354, 355, 913, 914

[56] References Cited

U.S. PATENT DOCUMENTS

| | | | |
|---|---|---|---|
| 4,370,370 | 1/1983 | Iwata et al. | 427/150 |
| 4,388,362 | 6/1983 | Iwata et al. | 427/150 |
| 4,424,245 | 1/1984 | Maruta et al. | 428/339 |

*Primary Examiner*—Bruce H. Hess
*Attorney, Agent, or Firm*—Walter A. Hackler

[57] ABSTRACT

A thermosensitive recording label includes a substrate, a thermosensitive color-forming layer disposed on one side of the substrate, a protective layer disposed on the thermosensitive color-forming layer, a pressure-sensitive hot melt adhesive layer disposed on another side of the substrate and a releasable backing sheet disposed on the pressure-sensitive adhesive layer. A hot melt adhesive layer absent sufficient modifying resin to prevent migration thereof and unwanted color formation in the color-forming layer enables use of the hot melt adhesive in the label. In addition, the use of hot melt adhesive enables the labels to be placed on refrigerated beef products without discoloration of the beef beneath the label.

10 Claims, 4 Drawing Figures

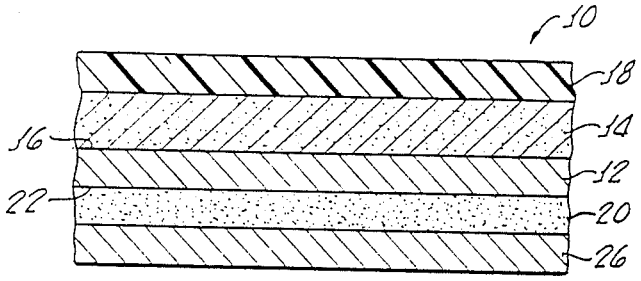
FIG. 1.
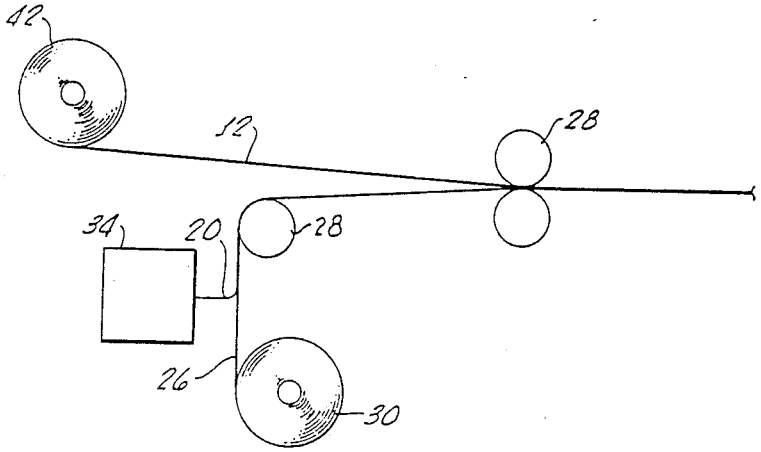
FIG. 2.
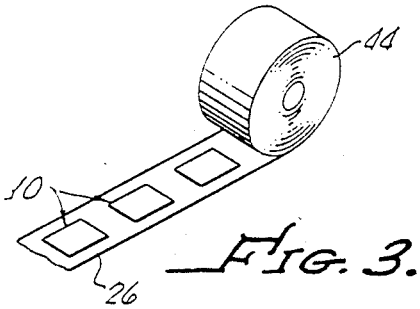
FIG. 3.
FIG. 4.
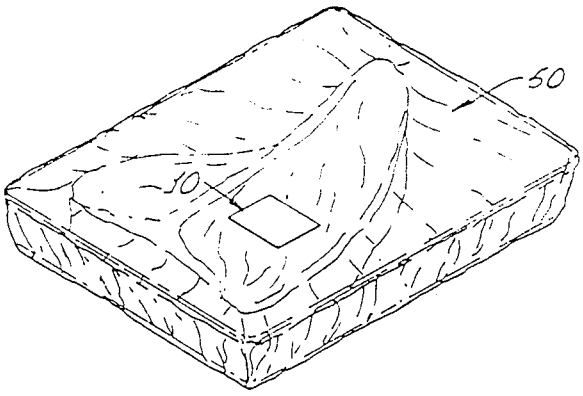

THERMOSENSITIVE RECORDING LABEL

This application is a Continuation-In-Part of U.S. patent application Ser. No. 614,287 Filed May 25, 1984 now U.S. Pat. No. 4,577,204.

The present invention relates generally to thermosensitive recording labels and more particularly relates to thermosensitive recording labels suitable for use on polyvinylchloride and polyethylene stretch wrapping films.

Thermosensitive recording labels such as described in U.S. Pat. No. 4,370,370 have been developed to overcome many of the drawbacks of conventional printing with oily or water base inks. Problems associated with conventional printing utilizing oily or water based inks include the smearing tendency of the ink due to insufficient drying time before utilization of the label, the high maintenance of printing equipment, and the continued replenishment of printing inks, or ribbons if ink impregnated ribbon is used in the printing process. In addition, it is well known that conventional printing with wet ink can be a very messy operation.

Hence, thermosensitive recording labels have been developed which utilize a thermosensitive coloring material comprising a colorless or light-colored leuco dye and acidic substance capable of causing the leuco dye to undergo color formation upon heating of the thermosensitive recording label.

As is well known in the art, a layer of thermosensitive coloring material is disposed on a substrate and a thermal head printer is thereafter used to contact and heat specific areas of the layer to cause color-formation in the areas heated, while the remainder of the layer stays colorless, or light-colored, thereby producing visible alphanumeric characters in the layer.

While these labels may be used on many products without fading of the color formations over long periods of time, it is also well known that when such labels are placed on plastic wrapped products, contact with the plastic wrap from co-mingled products or packages is inevitable. When this occurs, degradation of the heat formed printing begins as evidenced by fading of the color formed by the leuco dye and the acidic substance.

It is believed that this degradation occurs because migration of the plasticizers used in the plastic wrap occurs. This migration of the plasticizer into the thermosensitive color-forming layer and subsequent reaction therein is believed to cause the fading phenomenon.

As disclosed in U.S. Pat. No. 4,370,370, an attempt to produce a non-fading thermosensitive recording label has included the addition of protective, or barrier, layers on both sides of the thermosensitive color-forming layer in order to prevent such migration.

Specifically, after the color-forming layer is applied to a substrate, a barrier layer comprising a water soluble polymeric material is placed over the thermosensitive color forming area, and a second barrier comprising a water soluble polymeric material is placed on the other side of the substrate.

The barrier layer on the substrate is provided to prevent migration of plasticizers from the plastic film on which the label is placed from migrating through the substrate and into the color-forming layer, and the barrier layer placed on the thermosensitive color-forming layer is intended to prevent migration of plasticizers from co-mingled plastic wrapped goods which may come in contact with the label, for migrating thereinto.

While this combination of layers is satisfactory for use as a thermosensitive recording label in many applications, manufacture of the label is made more costly and additional steps must be taken in the production of the label in order to incorporate the barrier label on the substrate.

In addition, it has been found that when such label is placed on plastic stretch wrap film containing beef products, that a dark discoloring of the beef products occurs beneath the label a few hours after application of the label to the packaged beef.

While it is not believed that any deterioration or spoilage of the beef products occurs because of this darkened area, it nonetheless is unattractive to the consumer after removal of the plastic wrap and renders the beef product unacceptable for use by the consumer.

It is not known at the present time exactly why this discoloration occurs only on beef products, but it is suspected to be related to the lack of oxygen penetration beneath the label.

Prior art sensitive recording labels have typically used an acrylic adhesive agent, a styrene-butadiene rubber (SBR) latex adhesive agent, a vinyl acetate adhesive agent or a rubber adhesive agent for securing the label, via the substrate, to goods.

While these adhesives are satisfactory for use on warm, relatively dry goods, they are not suitable for adhesives in holding the thermosensitive recording label to moist, damp, refrigerated or frozen plastic wrap goods such as packaged meats and vegetables or the like. Generally, refrigerated temperatures in the "cold" range are about 0° C. (32° F.) to about 15° C. (59° F.), while temperatures in the "freezer" range are about −10° C. (14° F.) to about 0° C. (32° F.).

The present invention overcomes many of the disadvantages of the hereinbefore produced thermosensitive recording labels. It has been found that the use of a hot melt adhesive layer applied to a thermosensitive recording label substrate enables a label, in accordance with the present invention, to be applied to moist and refrigerated goods at cold and frozen temperatures with sufficient adhesion thereto to ensure contact between the label and the goods even though they may rub up against and come in contact with associated goods during handling of the product.

Further, a label, in accordance with the present invention, utilizing a hot melt type adhesive layer enables the production of a thermosensitive recording label without a barrier layer protecting the substrate. This reduces both the cost of the label and the complexity of manufacture because less steps are required. It appears that the hot melt adhesive prevents migration of the plasticizers from plastic film and the like, onto which the label is placed, from migrating through the hot melt adhesive and into the thermosensitive color-forming layer.

In addition, and importantly, it has been discovered that the use of a hot melt adhesive layer, in combination with the substrate and thermosensitive color-forming layer, results in a thermosensitive recording label that can be used on refrigerated beef products without discoloration of the beef beneath the labels as occurs with hereinbefore manufactured thermosensitive recording labels.

SUMMARY OF THE INVENTION

A thermosensitive recording label, in accordance with the present invention, includes a substrate, a thermosensitive color-forming layer disposed on one side of the substrate, a protective layer disposed on the thermosensitive color-forming layer, a pressure-sensitive hot melt adhesive layer disposed on opposite side of said substrate, and a releasable backing sheet disposed on said pressure-sensitive adhesive layer.

The thermosensitive color-forming layer comprises a colorless, or light colored leuco dye and an acidic substance capable of causing the leuco dye to undergo color formation upon heating of the thermosensitive recording label.

More particularly, the pressure-sensitive hot melt adhesive layer utilized in the present invention is absent sufficient modifying resin to prevent migration thereof through the substrate to cause unwanted color formation, or bleeding, in the thermosensitive color-forming layer.

In a preferred embodiment of the present invention, the thermosensitive recording label includes a pressure-sensitive hot melt adhesive layer comprising at least one adhesive agent selected from the group consisting of thermoplastic styrene-butadiene rubber hot melt adhesive, and acrylic hot melt adhesive and having a transition glass temperature at most about 50° C.

The adhesive agent selected enables reliable adhesion of the thermosensitive recording label on refrigerated beef products wrapped with a plastic stretch film wrap selected from the group consisting of polyvinylchloride, polyethylene and polyolefin without subsequent discoloration of the beef beneath the thermosensitive recording label at temperatures between about −10° C. (14° F.) and about 15° C. (59° F.). The pressure-sensitive hot melt adhesive layer on the present thermosensitive recording label invention may have a thickness from about 15 μm (0.6 mil) to about 23 μm (0.9 mil).

BRIEF DESCRIPTION OF THE DRAWINGS

A better understanding of the present invention may be had from the consideration of the following detailed description, taken in conjunction with the accompanying drawings in which:

FIG. 1 is a cross-sectional view of the thermosensitive recording label in accordance with the present invention generally showing each of the layers included in the label;

FIG. 2 is a diagram showing the production of a thermosensitive recording label in accordance with the present invention showing specifically the application of hot melt adhesives to a backing sheet and subsequent combination of the backing sheet with the remainder of the label with chilled rollers;

FIG. 3 is a perspective view of a roll of thermosensitive recording labels according to the present invention; and, FIG. 4 is a perspective drawing of the thermosensitive recording label in accordance with the present invention as applied to a plastic wrapped refrigerated product.

DETAILED DESCRIPTION

Turning now to FIG. 1, the thermosensitive recording label 10 in accordance with the present invention includes a substrate 12, a thermosensitive color-forming layer 14 disposed on one side 16 of the substrate 12, a protective layer 18 disposed on the thermosensitive color-forming layer 14, a pressure-sensitive hot melt adhesive layer 20 disposed on an opposite side 22 of the substrate 12 and a releasable backing sheet 26 disposed on the pressure-sensitive adhesive layer 20.

In general, the substrate 12 may be a high quality paper and the thermosensitive recording color-forming layer 14 is typical of that known in the art as shown in U.S. Pat. Nos. 4,370,370 and 4,388,362, examples of the colorless or light colored leuco dye and the acidic substances being given therein.

Additionally, as pointed out in U.S. Pat. No. 4,388,362 enhancers may be included in the thermosensitive color-forming layer in order to enhance the distinctiveness of the color images. Such enhancers may include fine powders of calcium carbonate, magnesium carbonate, alumina, silica, talc, barium sulfate, aluminum sterate, styrene resin, urea-formalin resin, or the like. Binder agents also may be utilized in thermosensitive color-forming layers as is well known in the art.

A water soluble resin solution coated on the thermosensitive color-forming layer 14 and thereafter dried forms the protective layer 18. A number of water soluble resins may be utilized in the thickness of the protective layer 18, as is well known in the art, to prevent subsequent deterioration of the thermosensitive color-forming layer by plasticizers contained in plastic sheet which may be placed on, or in contact with the thermosensitive recording label 10.

Also, in accordance with the prior art, the function of the protective, or barrier layer may be enhanced by adding water resisting property improvement agents such as formaldehyde, a glyoxal, chromium alum, melamine, melamine-formaldehye resin, polyamide resin.

As generally shown in FIG. 2, the pressure-sensitive hot melt adhesive layer 20, such as thermoplastic rubber copolymer or acrylic thermoplastic hot melt adhesive is disposed on the substrate 26 by heating the hot melt adhesive to a temperature of about 177° C. (350° F.) and thereafter forming a film on the substrate.

It should be appreciated that the hot melt rubber adhesives utilized in the present invention are solid at room temperature but liquid when heated above about 177° C. (300° F.).

Hot melt adhesives are generally block copolymers which display both elastomeric and thermoplastic properties. The backbone or primary constituent of a hot melt adhesive is a thermoplastic high-molecular-weight polymer such as polyethylene, ethylene copolymers, is ethylene-vinyl acetate, polypropylene, polyamides, .polyesters and styrene-isoprene and styrene-butadiene black polymer rubbers.

Higher molecular weight polymers above a certain limit are not suitable for adhesives used at cold or freezer temperatures because reliable adhesion does not occur.

It is well known that as the temperature of a polymer melt or rubber is lowered, a point known as the glass-transition temperature (Tg) is reached where polymeric materials undergo a marked change in properties. Below their glass-transition temperature, polymeric material exhibit marked increase in stiffness and brittleness. Hence, it has been found that polymeric adhesives with glass-transition temperatures greater than about 50° C. (122° F.) are not suitable as adhesives for cold or freezer temperatures because these properties at the cold or freezer temperatures result in insufficient or unreliable adhesion.

More specifically it has been found that polymeric adhesives with glass-transition temperatures between about −17° C. (1° F.) to about 15° C. (59° F.) are best suited for cold or freezer temperature use.

Continuing, the substrate 26 with the hot melt adhesive thereon is contacted with the other side 22 of the substrate 12 by passing the backing sheet 26 along with the substrate 12 through a set 28 of chilled rollers thereby disposing the hot melt adhesive 20 onto the substrate 12 without significant heating of the thermosensitive color-forming layer 14.

This is diagrammatically shown in FIG. 2 where a roll 30 of backing sheet 26 material which may be high quality paper or densified silicone coated craft paper coated with a film of molten hot melt adhesive 20 by an extruder 34 in a conventional manner and thereafter passed through the chilled rollers 28 along with the substrate 12 already coated with the thermosensitive color-forming layer 14 and barrier 18, pulled from a roll 42.

The resulting labels may be formed into a roll 44 (see FIG. 3) for ease in subsequent use.

It should also be appreciated that the releasable backing sheet 26 may be silicone coated and/or the substrate surface 22 treated in a manner such that the pressure-sensitive hot melt adhesive layer 20 remains on the substrate surface 22 when the releasable backing sheet 26 is removed or peeled therefrom to enable the thermosensitive recording label 10 to be fixed to goods 50 (see FIG. 4).

As hereinabove discussed, hot melt adhesives have a thermoplastic high-molecular-weight backbone polymer. The backbone polymers are usually modified with tackifying resins, waxes or oils.

While the proper modifying resins can improve adhesion as well as act as a fluxing agent to bring together otherwise poorly compatible ingredients of the adhesions, it has been found that certain modifying agents will migrate through the adhesive and thereafter the substrate of a label and cause unwanted color formation in the color-forming layers. This is called bleeding.

Modifying resins found to cause bleeding include terpene resins such as alpha and beta-pinenes, resins, rosin, esters, hydrocarbon resin, phenolic resins, terpene modified phenolic resins and ketone aldehydes.

The specific amount of modifying resin in a hot melt adhesive sufficient to cause bleeding is dependent on many factors including the average molecular weight of the backbone polymer (as may be described by its transition-glass temperature), the specific modifying resin as well as the thickness of the adhesive layer, the latter relating to the total amount of modifying resin present.

Examples of commercially available adhesives not suitable for thermosensitive recording labels because of bleeding caused by modifying resin migration are adhesive number 701 available from Century Adhesives Corporation, Columbus, Ohio; number X806-338-01 available from Findly Adhesives, Inc., Elmgrove, WI.; and number 1705 available from Malcolm Nicol and Company, Inc., Lyndhurst, N.J.

The average molecular weight of the adhesive backbone polymer, the molecular weight distribution and the copolymer network are important factors relating to bleeding caused by migration of the modifying resins, because these characteristics of the backbone polymer affect the ability of the modifying resin to move, as well as the rate of movement of the modifying resin.

The lower the Tg, the lower the backbone molecular weight and typically less copolymer network. Less copolymer network, or cross linking, enables easier movement of modifying resins therein and consequently a greater amount of bleeding problems.

All of the above factors are interrelated, hence best described by specific example as hereinafter set forth.

The following examples are presented by way of illustration only, and is not to be considered limiting to the present invention.

EXAMPLE 1

A solution of leuco dye and acid substance was prepared as follows:

| | Parts by Weight |
|---|---|
| Dispersant A | |
| 3-diethyl-6-methyl-7-anilino fluoran | 1.5 |
| Polyvinyl alcohol (20% aqueous solution) | 5.0 |
| Water | 43.5 |
| Dispersant B | |
| Bisphenol A | 6.0 |
| Stearic acid amide | 1.0 |
| Polyvinyl alcohol (20% aqueous solution) | 10.0 |
| Water | 33.0 |

The prepared Dispersant A and Dispersant B were mixed to form a thermosensitive color liquid which was applied to a substrate consisting of high quality paper and weighing about 58 gr./m$^2$, and thereafter dried at room temperature up to 120° C. (248° F.) to form a thermosensitive color-forming layer in which the solids therein amounted to about 4.0 to about 10 gr./m$^2$. Thereafter, a water soluble resin solution comprising 5 parts of polyvinyl alcohol in 95 parts of water was applied to the heat sensitive color-forming layer and dried at about 25° to 120° C. (77° to 248° F.) to thereby form a protective layer over the thermosensitive color-forming layer, said protective layer having a quantity of solids of about 2 gr./m$^2$.

A backing sheet consisting of high quality paper and weighing about 70 grs./m$^2$ was silicone treated by either solvent-base or 100% solid release paper coating and thereafter cold or freezer type hot melt adhesive having a Tg of less than 50° C. such as Duro-TAK 34 (available from National Starch and Chemical Corporation, Bridgewater, N.J.) was heated to 177° C. (350° F.) and applied to the substrate, such application amounting to a layer having a quantity of solids of about 23 gr./m$^2$. Other suitable commercially available adhesives are manufactured by Findly Adhesives, Inc., (X806-338-02), H. B. Fuller Company, St. Paul, MN., (#½ HM-1597, HM-18al) and Malcolm Nicol and Company, Inc., (#1825). Thereafter, the backing sheet with the hot melt adhesive applied thereto was passed through chilled rollers to contact the substrate material and form a roll of thermosensitive recording labels.

The labels were then printed with a heated printing head and applied to a beef filet mignon wrapped with polyethylene or polyolefin stretch plastic film, which has been refrigerated. The label adhered to and was not easily removed from the plastic film and after 24 hours at a refrigerated temperature of about 37° F., (2° C.) the plastic film, along with the thermosensitive label, was removed from the filet mignon. On subsequent examination, the filet mignon showed no discoloration under the label disposed on the plastic wrap over the filet mignon. In addition, no bleeding was observed in the color-forming layer after a period of about 72 hours.

By comparison, a label made in accordance with U.S. Pat. No. 4,370,370 utilizing an acrylic adhesive agent did not adhere well to the refrigerated plastic film material covering the filet mignon. In addition, it was observed that after a lapse of approximately 4 hours, a discoloration of the filet mignon was observed underneath the prior art label. Also, by comparison, a label was prepared with CA-701 adhesive available from Century Adhesive Corporation and thereafter printed and applied to the beef filet mignon wrapped with polyethylene or polyolefin stretch plastic film. While the adhesions were good and no discoloration of the beef occurred, bleeding was observed after about 6 hours.

EXAMPLE 2

A label prepared as in Example 1 was applied to a beef sirloin steak wrapped with polyethylene or polyolefin stretch plastic film which had been refrigerated. The label adhered to and was not easily removed from the plastic sheet and after 24 hours at a refrigerated temperature of about 37° F., (2.° C.), the plastic film, along with the thermosensitive label, was removed from the sirloin steak. On subsequent examination, the sirloin steak showed no discoloration under the label disposed on the plastic film over the sirloin steak.

By comparison, a label made in accordance with U.S. Pat. No. 4,370,370 utilizing an acrylic adhesive agent did not adhere well to the refrigerated plastic sheet material covering the sirloin steak. In addition, it was observed that after a lapse of approximately 6 to 8 hours a discoloration of the sirloin steak was observed underneath the prior art label.

EXAMPLE 3

A label prepared as in Example 1 was applied to a New York steak wrapped with polyethylene or polyolefin stretch plastic film which had been refrigerated. The label adhered to and was not easily removed from the plastic sheet and after 24 hours at a refrigerated temperature of about 37° F. (2° F.), the plastic sheet, along with the thermosensitive label, was removed from the New York steak. On subsequent examination, the New York steak showed no discoloration under the label disposed on the plastic film over the New York steak, By comparison, a label made in accordance with U.S. Pat. No. 4,370,370 utilizing an acrylic adhesive agent did not adhere well to the refrigerated plastic film material covering the New York steak. In addition, it was observed that after a lapse of approximately 6 to 8 hours a discoloration of the New York steak was observed underneath the prior art label.

Although there has been described hereinabove a specific thermosensitive recording label in accordance with the present invention for the purposes of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A thermosensitive recording label for use on beef products wrapped with plastic film comprising:

a substrate;

a thermosensitive color-forming layer disposed on one side of said substrate, said thermosensitive color-forming layer comprising a colorless or light-colored leuco dye and acidic substance capable of causing said leuco dye to undergo color formation upon heating of the thermosensitive recording label;

a protective layer disposed on said thermosensitive color-forming layer;

a pressure-sensitive hot melt adhesive layer disposed on another side of said substrate, said pressure-sensitive hot melt adhesive being absent sufficient modifying resin, selected from the group consisting of terpene resin, rosin resins, hydrocarbon resins, phenolic resins and ketone aldehydes, to prevent migration thereof into the thermosensitive color-forming layer, resulting in bleeding of the color formation in the thermosensitive color-forming layer; and, a releasable backing sheet disposed on said pressure-sensitive hot melt adhesive layer.

a releasable backing sheet disposed on said pressure-sensitive hot melt adhesive layer.

2. A thermosensitive recording for use on beef products wrapped with plastic film comprising:

a substrate;

a thermosensitive color-forming layer disposed on one side of said substrate, said thermosensitive color-forming layer comprising a colorless or light-colored leuco dye and acidic substance capable of causing said leuco dye to undergo color formation upon heating of the thermosensitive recording label;

a protective layer disposed on said thermosensitive color-forming layer;

a pressure-sensitive hot melt adhesive layer disposed on another side of said substrate, said pressure-sensitive hot melt adhesive being absent sufficient modifying resin, selected from the group consisting of terpene resins, rosin resins, hydrocarbon resins, phenolic resins and ketone aldehydes, to prevent migration of said modifying resin through the substrate causing unwanted color-formation in the thermosensitive color-forming layer; and, a releasable backing sheet disposed on said pressure-sensitive hot melt adhesive layer.

3. The thermosensitive recording label according to claim 1 or 2 wherein the pressure-sensitive hot melt adhesive layer comprises at least one adhesive agent selected from the group consisting of a styrene-butadiene rubber hot melt adhesive and an acrylic hot melt adhesive.

4. The thermosensitive recording label according to claim 3 wherein the pressure-sensitive hot melt adhesive layer has a transition glass temperature of at most about 50° C.

5. The thermosensitive recording label according to claim 4 wherein the pressure-sensitive hot melt adhesive layer has a transition glass temperature of between about −17° C. and about 15° C.

6. The thermosensitive recording label according to claim 1 or 2 wherein said modifying resin is selected from the group consisting of terpene resins, rosin resins, hydrocarbon resins, phenolic resins and ketone aldehydes.

7. The thermosensitive recording label according to claim 6 wherein the pressure-sensitive hot melt adhesive layer has a thickness from about 15 μm (0.6 mil) to about 23 μm (0.9 mil).

8. A thermosensitive recording label comprising:

a substrate;

a thermosensitive color-forming layer disposed on one side of said substrate, said thermosensitive color-forming layer comprising a colorless or light-colored leuco dye and acidic substance capable of causing said leuco dye to undergo color formation upon heating of the thermosensitive recording label;

a protective layer disposed on said thermosensitive color-forming layer;

a pressure-sensitive hot melt adhesive layer disposed on an opposite side of said substrate, said pressure-sensitive hot melt adhesive being absent sufficient modifying resin selected from the group consisting of terpene resins, rosin resins, hydrocarbon resins, phenolic resins and ketone aldehydes, to prevent migration of said modifying resins through the substrate causing unwanted color formation in the thermosensitive color-forming layer, said pressure-sensitive hot melt adhesive layer having a thickness from about 15 μm (0.6 mil) to about 23 μm (0.9 mil); and, a releasable backing sheet disposed on said pressure-sensitive hot melt adhesive layer.

9. The thermosensitive recording label according to claim 8 wherein the adhesive agent selected enables the use of the thermosensitive recording label on refrigerated beef products wrapped with a plastic stretch film wrap selected from the group consisting of polyvinylchloride, polyethylene and polyolefin without subsequent discoloration of the beef beneath the thermosensitive recording label.

10. The thermosensitive recording label according to claim 9 wherein the hot melt adhesive layer includes a hot melt adhesive having a transition glass temperature of at most about 50° C. for enabling adhesion to the plastic stretch film wrap at temperatures from about −10° C. to about 15° C.

* * * * *